US008786540B2

(12) United States Patent
Pauritsch

(10) Patent No.: US 8,786,540 B2
(45) Date of Patent: Jul. 22, 2014

(54) CIRCUIT ARRANGEMENT AND METHOD FOR DRIVING SEGMENTED LED BACKLIGHTS IN PARTICULAR

(75) Inventor: Manfred Pauritsch, Graz (AT)

(73) Assignee: AMS AG, Unterpremstätten (AT)

( * ) Notice: Subject to any disclaimer, the term of this patent is extended or adjusted under 35 U.S.C. 154(b) by 382 days.

(21) Appl. No.: 12/669,752

(22) PCT Filed: Jul. 10, 2008

(86) PCT No.: PCT/EP2008/059023
§ 371 (c)(1),
(2), (4) Date: Jun. 17, 2010

(87) PCT Pub. No.: WO2009/010449
PCT Pub. Date: Jan. 22, 2009

(65) Prior Publication Data

US 2010/0315442 A1 Dec. 16, 2010

(30) Foreign Application Priority Data

Jul. 18, 2007 (DE) ..... 10 2007 033 471

(51) Int. Cl.
*G09G 3/36* (2006.01)

(52) U.S. Cl.
USPC ..... 345/102; 345/690

(58) Field of Classification Search
USPC ..... 345/102, 690–693
See application file for complete search history.

(56) References Cited

U.S. PATENT DOCUMENTS

| | | | | |
|---|---|---|---|---|
| 6,982,686 | B2 * | 1/2006 | Miyachi et al. | 345/73 |
| 7,113,164 | B1 | 9/2006 | Kurihara | |
| 7,768,216 | B2 * | 8/2010 | Pauritsch | 315/360 |
| 7,773,065 | B2 | 8/2010 | Kumamoto | |
| 7,956,838 | B2 | 6/2011 | Mizumaki | |
| 8,120,276 | B2 | 2/2012 | Huber et al. | |
| 2001/0028335 | A1 | 10/2001 | Hasegawa et al. | |
| 2002/0057238 | A1 | 5/2002 | Nitta et al. | |
| 2002/0159002 | A1 | 10/2002 | Chang | |
| 2004/0056825 | A1 | 3/2004 | Min et al. | |
| 2004/0125062 | A1 | 7/2004 | Yamamoto | |
| 2004/0179003 | A1 | 9/2004 | Jang | |
| 2006/0001641 | A1 * | 1/2006 | Degwekar et al. | 345/102 |
| 2006/0125742 | A1 | 6/2006 | Sekiguchi et al. | |
| 2006/0164369 | A1 | 7/2006 | Park | |
| 2006/0208999 | A1 | 9/2006 | Lee et al. | |
| 2007/0024574 | A1 * | 2/2007 | Wu | 345/102 |
| 2007/0063962 | A1 * | 3/2007 | Nanataki et al. | 345/102 |
| 2007/0152926 | A1 | 7/2007 | Kwon | |
| 2008/0074381 | A1 * | 3/2008 | Kumamoto | 345/102 |

FOREIGN PATENT DOCUMENTS

| | | |
|---|---|---|
| DE | 695 12 704 | 4/2000 |
| DE | 103 57 776 | 7/2005 |
| DE | 10 2005 049 579 | 4/2007 |
| EP | 0 685 831 | 12/1995 |

(Continued)

*Primary Examiner* — Amr Awad
*Assistant Examiner* — Aaron Midkiff
(74) *Attorney, Agent, or Firm* — McDermott Will & Emery LLP

(57) ABSTRACT

A circuit arrangement for controlling a segmented LED backlight in particular, comprises a generator (50) with a first input (10) to be supplied with a synchronizing signal (SYNC) that comprises image frequency information and/or line frequency information of a display unit, a second input (20) to be supplied with a data signal (DATA) that comprises image information of the display unit, and with an output (30) for providing a modulated signal (MOD).

20 Claims, 5 Drawing Sheets

(56) References Cited

FOREIGN PATENT DOCUMENTS

| | | |
|---|---|---|
| JP | 2000-069432 | 3/2000 |
| JP | 2001-147675 | 5/2001 |
| JP | 2001-195031 | 7/2001 |
| JP | 2002-156950 | 5/2002 |
| JP | 2004-191490 | 7/2004 |
| JP | 2005-128561 | 5/2005 |
| JP | 2006-178435 A | 7/2006 |
| WO | WO-2006/080254 A1 | 8/2006 |
| WO | WO 2007/045601 | 4/2007 |

* cited by examiner

CIRCUIT ARRANGEMENT AND METHOD FOR DRIVING SEGMENTED LED BACKLIGHTS IN PARTICULAR

RELATED APPLICATIONS

This is a U.S. national stage of application No. PCT/EP2008/059023, filed on Jul. 10, 2008.

This application claims the priority of German application no. 10 2007 033 471.2 filed Jul. 18, 2007, the entire content of which is hereby incorporated by reference.

FIELD OF THE INVENTION

The invention relates to a circuit arrangement and a method for driving segmented LED backlights in particular.

BACKGROUND OF THE INVENTION

Conventional displays produce white background illumination either by a cold cathode tube, white light-emitting diodes or by a combination of red, green and blue light-emitting diodes. Because of their fast turn-on time, backlights with light-emitting diodes allow control of the brightness by means of pulse modulation. Such LED backlights will be considered further here.

For a subjective increase of contrast, the LED backlighting of a display is typically subdivided into segments, each with its own driving and thus its own brightness control. The task of determining the brightness is taken on here by a digital video processor. The segments are conventionally driven by means of pulse-modulated signals that are generated independently of one another. This leads to intermodulation interference on the display, which is visible to the observer in the form of stripes.

SUMMARY OF THE INVENTION

One object of the present invention is to provide a circuit arrangement and a method with which intermodulation interference on displays with segmented LED backlighting, in particular, can be reduced.

In one embodiment, the circuit arrangement comprises a generator with a first input to be supplied with a synchronizing signal, a second input to be supplied with a data signal and with an output for providing a modulated signal. The synchronizing signal comprises line frequency information of a display unit. Every television and monitor system comprises a first frequency, referred to as the image frequency, for changing the picture, and a second frequency, referred to as the line frequency, for changing the line. The line frequency is synchronous with the image frequency, and is substantially higher. The data signal comprises image information of the display unit. The modulated signal comprises control information for controlling one segment of, for example, the segmented LED backlight.

The generator overlays the synchronizing signal with the data signal and generates the modulated signal at its output.

The modulated signal advantageously follows the clock rate of the synchronizing signal and is therefore synchronous with the line frequency of the display unit. Intermodulation interference is significantly reduced and/or eliminated in this way.

In one refinement, the synchronizing signal comprises image frequency information and line frequency information of the display unit.

In a preferred refinement of the circuit arrangement, the synchronizing signal is supplied via a phase-locked loop.

In one embodiment, a display driving unit comprises the generator and a driver. The driver has an input to be supplied with the modulated signal and an output for providing a control signal. The output of the generator is coupled to the input of the driver.

As a function of the modulated signal, the driver generates the output control signal for an LED segment, particularly of a segmented LED backlight, by supplying current or voltage.

The control signal is advantageously synchronous with the line and/or image frequency of the display unit. Intermodulation noise is thus significantly reduced.

In an advantageous refinement, the display driving unit comprises a second generator and a second driver. The second generator has an input to be supplied with the synchronizing signal, an input to be supplied with a second data signal and an output for providing a second modulated signal. The second data signal comprises image information for driving a second LED segment. The second driver has an input to be supplied with the second modulated signal and an output for providing a second control signal.

The second generator produces the second modulated signal by superimposing the synchronizing signal with the second data signal. By supplying current or voltage as a function of the second modulated signal, the second driver generates the second control signal.

Both the second modulated signal and the second control signal advantageously have the clock rate of the synchronizing signal. The two LED segments are thereby driven synchronously with the line and/or the image frequency of a display. Intermodulation interference is avoided.

In one embodiment, a display unit comprises the display driving unit, a first and second LED segment of a segmented LED backlight and a digital video processor. The digital video processor has one output for providing the synchronizing signal, an additional output for providing the first data signal and a third output for providing the second data signal. The first and second LED segments each comprises a series circuit of several LEDs. The outputs of the digital video processor are coupled to the associated inputs of the generators for the display driving unit. The LED segments are coupled to the outputs of the drivers of the display driving unit.

The digital video processor generates the synchronizing signal, as well as the first and second data signal with image information for driving the first and second LED segments. The display driving unit generates the first and second control signal by modulation of the synchronizing signal with the respective first or second data signal and subsequent supply of current or voltage. The first control signal is supplied to the first LED segment, and the second control signal is supplied to the second LED segment.

The first and the second LED segments are advantageously driven synchronously with one another and synchronously with the line and/or image frequency of the display unit. Intermodulation noise is significantly reduced.

In one embodiment, a method for generating the modulated signal comprises a supply of the synchronizing signal, which has line frequency of a display unit, a supply of the data signal, which has at least image brightness information of a display unit, and the provision of the modulated signal by superimposing the synchronizing signal with the data signal.

The modulated signal advantageously follows the clock rate of the synchronizing signal, and is therefore synchronous with the line frequency of the display unit. Intermodulation interference is thereby avoided.

In another embodiment, the synchronizing signal comprises image frequency information and line frequency information of the display unit.

In an advantageous refinement, a pulse-width modulation is used for superimposing the synchronizing signal with the data signal.

In another advantageous refinement, a sigma-delta modulation is used for superimposing the synchronizing signal with the data signal.

BRIEF DESCRIPTION OF THE DRAWINGS

The invention will be described in detail below for several embodiments with reference to the figures. Components and circuit parts that are functionally identical or have the same effect bear identical reference numbers. Insofar as circuit parts or components correspond to one another in function, they will not be described again in each of the following figures.

Therein.

DETAILED DESCRIPTION OF THE DRAWINGS

Figure 1:
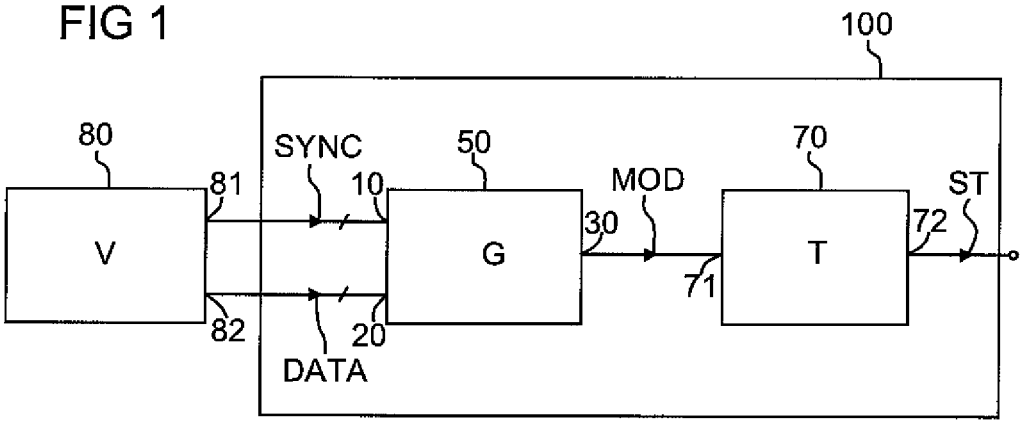
FIG. 1 shows an embodiment example of a circuit arrangement according to the invention.

FIG. 1 shows an embodiment example of a circuit arrangement according to the invention. The circuit arrangement comprises a digital video processor 80 and a display driving unit 100. Display driving unit 100 comprises a generator 50 and a driver 70. Digital video processor 80 has a first output 81 and a second output 82. Generator 50 has a first input 10, a second input 20 and an output 30. Driver 70 has an input 71 and an output 72. First output 81 of digital video processor 80 is connected to first input 10 of generator 50. Second output 82 of digital video processor 80 is connected to second input 20 of generator 50. Output 30 of generator 50 is connected to input 71 of driver 70.

Digital video processor 80 provides a synchronizing signal SYNC at its first output 81, and a data signal DATA at its second output 82. Generator 50 provides a modulated signal MOD at its output 30. Driver 70 provides a control signal ST at its output 72. An arrangement consisting of generator 50 and driver 70, which are coupled in the described manner and comprise the described inputs and outputs, is referred to as a display driving unit 100.

At its first output 81, digital processor 80 generates the synchronizing signal SYNC, which has the image frequency and/or the line frequency of a display unit, and at its second output 82, the data signal DATA, which comprises at least image brightness information of a display unit. Generator 50 modulates the synchronizing signal SYNC present at its first input 10 with the data signal DATA present at its second input 20 and provides the modulated signal MOD generated from them at its output 30. As a function of the modulated signal MOD present at its input 71, driver 70 generates the control signal ST at its output 72 by supplying current or voltage. The control signal ST is fed to one segment of a segmented LED backlight, in particular.

Both the modulated signal MOD and the control signal ST are advantageously synchronous with the image and/or line frequency of the display unit. Intermodulation noise can thereby be reduced.

Figure 2A:
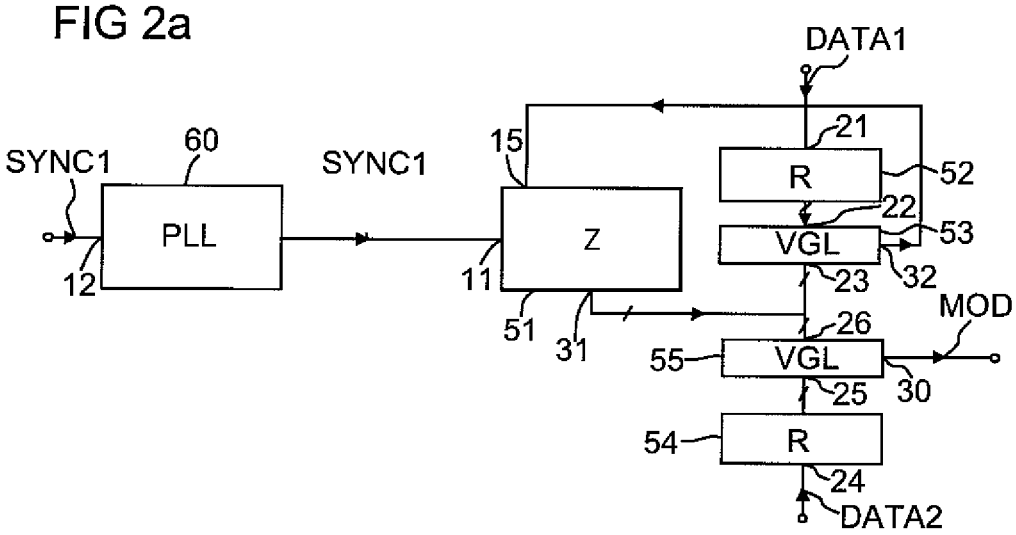
FIGS. 2*a* and 2*b* show an embodiment example of a generator according to the invention based on a pulse-width modulation, and associated exemplary pulse diagrams.

FIG. 2*a* shows an embodiment example of generator 50 from FIG. 1 based on a pulse-width modulation. The circuit comprises a programmable counter 51, a first register 52, a first comparator 53, a second register 54, a second comparator 55 and a first phase-locked loop 60. Programmable counter 51 comprises an input 11, a reset input 15 and an output 31. First register 52 has an input 21 to be supplied with the pulse-width signal DATA1, which comprises a first image information value P. First comparator 53 has a first input 22, a second input 23, and an output 32. Second register 54 has an input 24 to be supplied with a brightness signal DATA2, which has a second image information value M. Second comparator 55 has a first input 25, a second input 26, and an output 30. First phase-locked loop 60 has an input 12 to be supplied with a line signal SYNC1 and an output at which the supplied line signal SYNC1 is provided at its own frequency or at a frequency derived therefrom, for example a multiple thereof. Line signal SYNC1 comprises line frequency information, for example. This second image information value M comprises, for example, brightness information of an image to be displayed, wherein: $0 \leq M \leq P$. The output of first phase-locked loop 60 is connected to input 11 of programmable counter 51. Output 31 of programmable counter 51 is connected to input 23 of first comparator 53 and to input 26 of second comparator 55. Output 32 of first comparator 53 is connected to reset input 15 of programmable counter 51. The modulated signal MOD can be tapped at output 30 of second comparator 55. The first image information value P can be adjusted corresponding to the desired repetition frequency of the modulated signal MOD.

The line signal SYNC1 is supplied via first phase-locked loop 60 to input 11 of programmable counter 51. Programmable counter 51 counts the pulses of line signal SYNC1 and forms a respective counter state. The counter state provided at output 31 of programmable counter 51 is compared in first comparator 53 to the first image information value P. If the counter state has reached the first image information value P, output 32 of first comparator 53 is set to logic state 1. At the same time, programmable counter 51 is reset via the reset input 15. Second comparator 55 compares the counter state of programmable counter 51 with the second image information value M. As long as the counter state is less than the second image information value M, logic state 1 is present at output 30 of second comparator 55. As soon as the second image information value M is reached, output 30 of first comparator 55 goes to logic state 0.

The modulated signal MOD provided at output 30 of second comparator 55 advantageously follows the clock rate of line signal SYNC1. Because the line signal SYNC1 carries line frequency information of a display unit, for example, the modulated signal MOD is synchronized to this line frequency. Intermodulation noise is thereby significantly reduced or disappears completely.

In an alternative embodiment, the circuit of FIG. 2*a* can also be realized without first phase-locked loop 60. The line signal SYNC1 is then supplied directly to programmable counter 51 via its input 11.

Figure 2B:
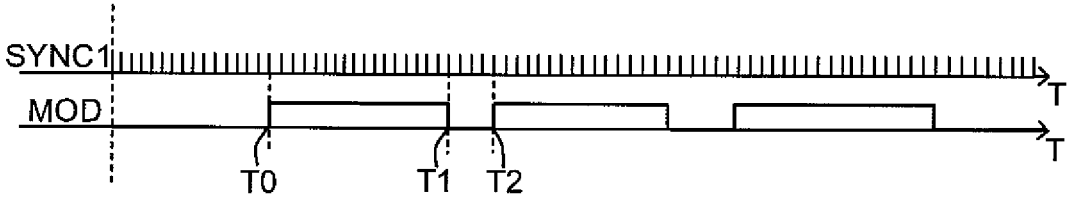

FIG. 2*b* shows a comparison of the progression over time of the line signal SYNC1 with the modulated signal MOD based on the corresponding pulse diagrams. Thus, the dynamic behavior of the circuit from FIG. 2*a* is illustrated. The progression of the line signal SYNC1 shows the pulses of, for example, the line frequency information of the display unit. At a starting point T0, programmable counter 51 is reset. As long as the counter state is less than the second image information value M, the modulated signal MOD remains at logic state 1. At a first time T1, the counter state has reached the second image information value M and the modulated signal MOD goes to logic state 0. At a second time T2, the counter state has reached the first image information value P. Programmable counter 51 is reset and the signal MOD thus again takes on the logic state 1.

It is clearly recognizable from FIG. 2*b* that the modulated signal MOD is advantageously synchronized to the line signal SYNC1, i.e., the line frequency of a display unit, for example.

Figure 3A:
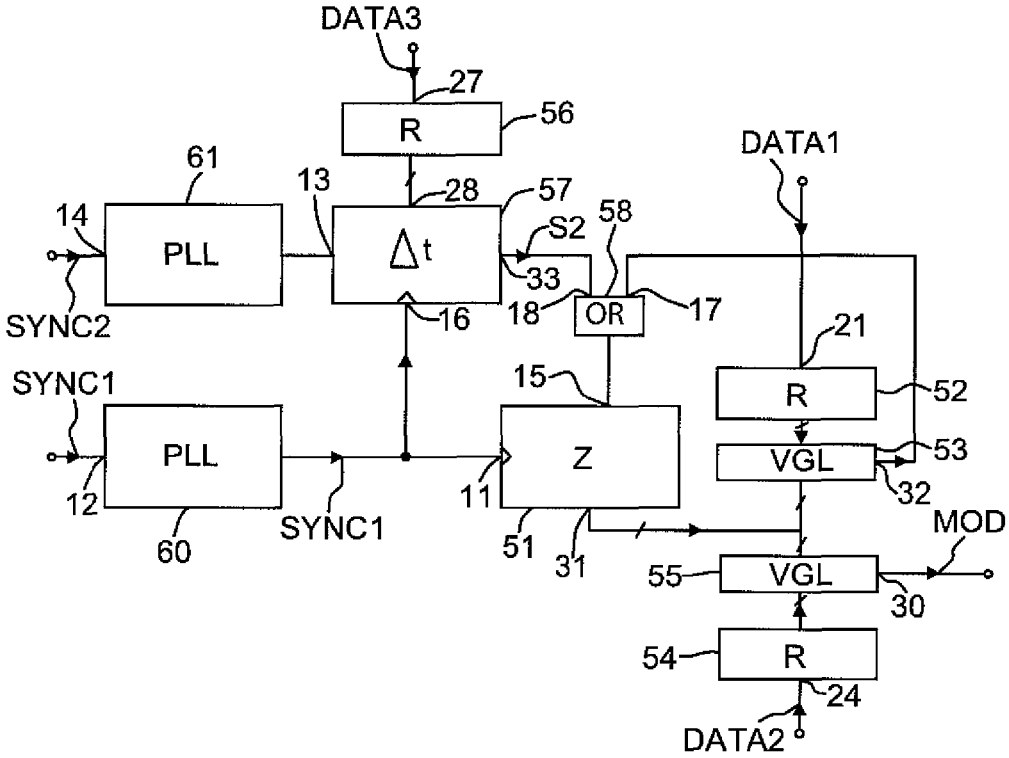
FIGS. 3*a* and 3*b* show another embodiment example of a generator according to the invention based on a pulse-width modulation, and associated examples of pulse diagrams.

FIG. 3*a* shows an additional embodiment example of generator 50 from FIG. 1, likewise based on a pulse-width modulation. The circuit of FIG. 3*a* comprises the circuit of FIG. 2*a*. In addition to the circuit of FIG. 2*a*, the present circuit comprises components to be supplied with an image signal SYNC2 and delay signal DATA3. The additional components are a third register 56 with an input 27 to be supplied with the delay signal DATA3, which has a third image information value N; a delay element 57 with a clock input 16 to be supplied with the line signal SYNC1; a first input 13 and a second input 28, as well as an output 33; an OR-gate 58 with a first input 17, a second input 18, and an output; and a second phase-locked loop 61 with an input 14 to be supplied with the image signal SYNC2 and an output. The image information signal SYNC2 comprises image frequency information, for example. The third image information value N has, for example, image delay information of the image to be displayed. The image delay information takes into account the delayed realignment of the crystals in a liquid-crystal display, LCD. Block dimming or line dimming is thereby made possible. The formation of streaks on an LCD can be avoided. The output of second phase-locked loop 61 is connected to input 13 of delay element 57. Output 32 of second comparator 53 is connected to input 17 of OR-gate 58. Output 33 of delay element 57 is connected to input 18 of OR-gate 58. The output of the OR-gate 58 is connected to reset input 15 of programmable counter 51. A delayed signal S2 can be tapped at output 33 of delay element 57. The modulated signal MOD can be tapped at output 30 of second comparator 55, as in FIG. 2*a*

At its output 33, delay element 57 generates the signal S2, which is delayed by the third image information value N for the image signal SYNC2 and follows the clock rate of line signal SYNC1. The delayed signal S2 can reset programmable counter 51 via OR-gate 58. Programmable counter 51 can also be reset by the logic state 1 at output 32 of first comparator 53. Programmable counter 51 begins to count with the first pulse of delayed signal S2 and forms a respective counter state. As long as the counter state is less than the second image information value M, the modulated signal MOD remains at logic state 1. As soon as the counter state has reached the second image information value M, the modulated signal goes to logic state 0. The first image information value P can have values greater than the third image information value N, or values less than the third image information value N. Depending on the choice of the first image information value P, programmable counter 51 is reset either via the delayed signal S2, or via the pulse generated at output 32 of first comparator 53 when the counter state P is reached.

The modulated signal MOD is advantageously synchronous with the line signal SYNC1 and the image signal SYNC2, i.e., the image and line frequency of a display unit. Intermodulation noise is thereby significantly reduced or avoided.

In an alternative embodiment of the circuit from FIG. 3*a*, both first phase-locked loop 60 and second phase-locked loop 61 can be omitted. In this case, the line signal SYNC1 is supplied directly to input 16 of delay element 57 and input 11 of programmable counter 51. The image signal SYNC2 is supplied directly to input 13 of delay element 57.

Figure 3B:
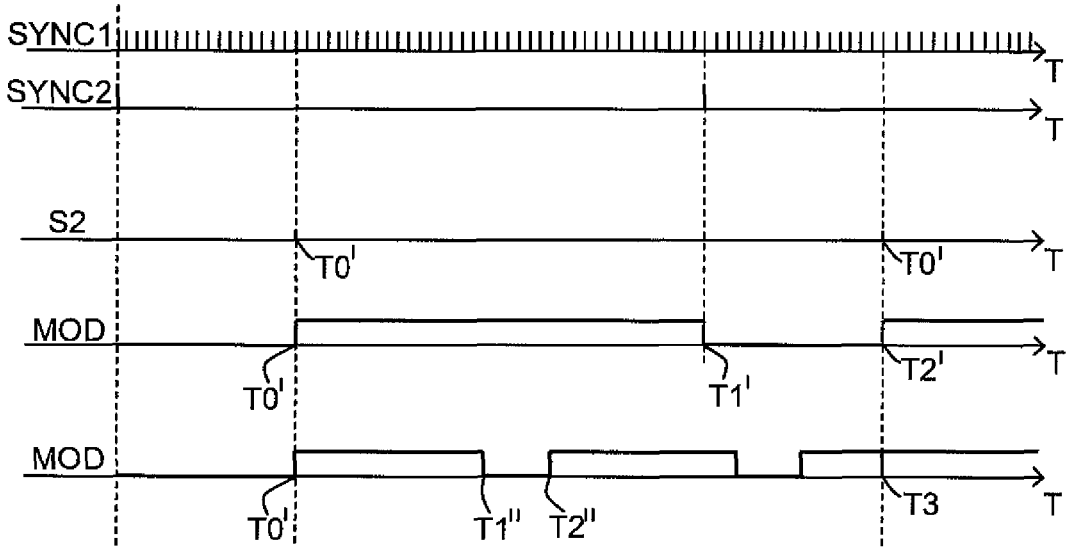

FIG. 3*b* shows the pulse diagrams associated with the circuit from FIG. 3*a*. The first line shows the progression over time of the line signal SYNC1, which carries the line frequency information. The second line shows the progression over time of the image signal SYNC2, which carries the image frequency information. The third line shows the progression over time of the delayed signal S2. The fourth line shows a first progression of the modulated signal MOD for the case where the first image information value P is greater than the period of the image signal SYNC2. The fifth line shows a second progression of the modulated signal MOD for the case where the first image information value P is less than the period of the image signal SYNC2.

At a respective starting time T0', the delayed signal S2 transmits the pulse delayed relative to the image signal SYNC2 by the third image information value N. As is evident in the fourth line, programmable counter 51 is started at the starting time T0'. The modulated signal MOD thereby assumes the logic state 1. At a first time T1', the counter state has reached the second image information value M and the modulated signal MOD goes to logic state 0. At a second time T2', programmable counter 51 is restarted via the pulse of the delayed signal S2. As is evident in the fifth line, programmable counter 51 is likewise started at the starting time T0' by the pulse of the delayed signal S2. The modulated signal MOD assumes the logic state 1. When the counter state has reached the second image information value M at a first intermediate time T1", the modulated signal goes to logic state 1. At a second intermediate time T2", the counter state has reached the first image information value P. This generates the reset pulse at input 15 of programmable counter 51. The process between the starting time T0' and the second intermediate time T2" repeats periodically up to a third time T3. At the third time T3 an additional pulse of the delayed signal S2 appears. This resets programmable counter 51, whereby the modulated signal MOD assumes the logic state 1.

From FIG. 3*b* it is clearly evident that the modulated signal MOD is advantageously synchronous with the line signal SYNC1 and the image signal SYNC2. The driving of a segment of the segmented LED backlight in particular is thus synchronous with the image frequency and the line frequency. Intermodulation interference on the display is thereby significantly reduced.

Figure 4A:
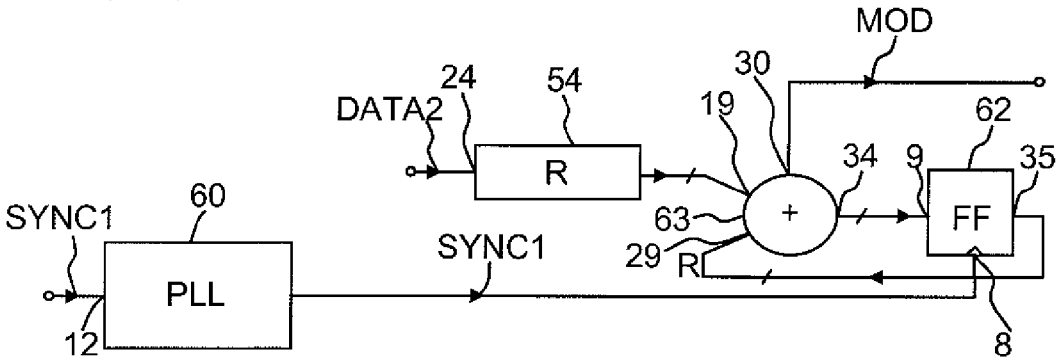
FIGS. 4*a* and 4*b* show a third embodiment example of a generator according to the invention based on a sigma-delta modulation, and associated examples of pulse diagrams.

FIG. 4*a* shows an embodiment example of generator 50 from FIG. 1 based on a sigma-delta modulation. The circuit comprises a second register 54, an n-bit wide adder 63, a chain of n flip-flops 62 and first phase-locked loop 60. Second register 54 has an input 24 to be supplied with a brightness signal DATA2, which comprises the second image information value M. The output of second register 54 is connected to input 19 of adder 63. Flip-flop chain 62 has a clock input 8, a n-bit wide input 9 and a n-bit wide output 35. Adder 63 has an input 19, a reset input 29, a first n-bit wide output 34 and a second output 30 for providing the modulated signal MOD. First phase-locked loop 60 has an input 12 to be supplied with the line signal SYNC1, which comprises line frequency information, for example. The output of first phase-locked loop 60 is connected to clock input 8 of flip-flop chain 62. Output 35 of flip-flop chain 62 is connected to reset input 29 of adder 63. Output 34 of adder 63 is connected to reset input 9 of flip-flop chain 62.

By means of sigma-delta modulation of the brightness signal DATA2, the present circuit generates the modulated signal MOD, which is synchronized to the clock of the line signal SYNC1, at output 30 of adder 63. The mean value of the modulated signal MOD corresponds to the mean value of the brightness signal DATA2.

The modulated signal MOD is advantageously synchronous with the line signal SYNC1, which comprises line frequency information, for example. Intermodulation noise is thereby significantly reduced.

Alternatively, the present circuit can also be constructed without first phase-locked loop 60. The line signal SYNC1 is then supplied directly to clock input 8 of flip-flop chain 62.

Figure 4B:
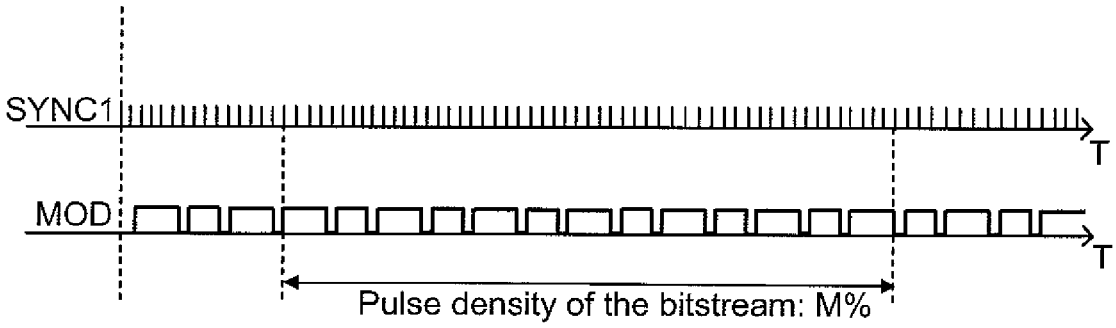

FIG. 4*b* shows pulse diagrams of the line signal SYNC1 and the modulated signal MOD. The modulated signal MOD is generated as a bitstream by the sigma-delta modulation, performed in the ordinary manner, of the brightness signal DATA2 that transmits the second image information value M. The pulse density of the bitstream is M percent, corresponding to the mean value over time of the brightness signal DATA2.

It is clearly recognizable from FIG. 4*b* that the modulated signal MOD is synchronous with the line signal SYNC1, i.e., the line frequency of the display unit, for example. Intermodulation noise is thereby significantly reduced by the synchronized driving.

Figure 5:
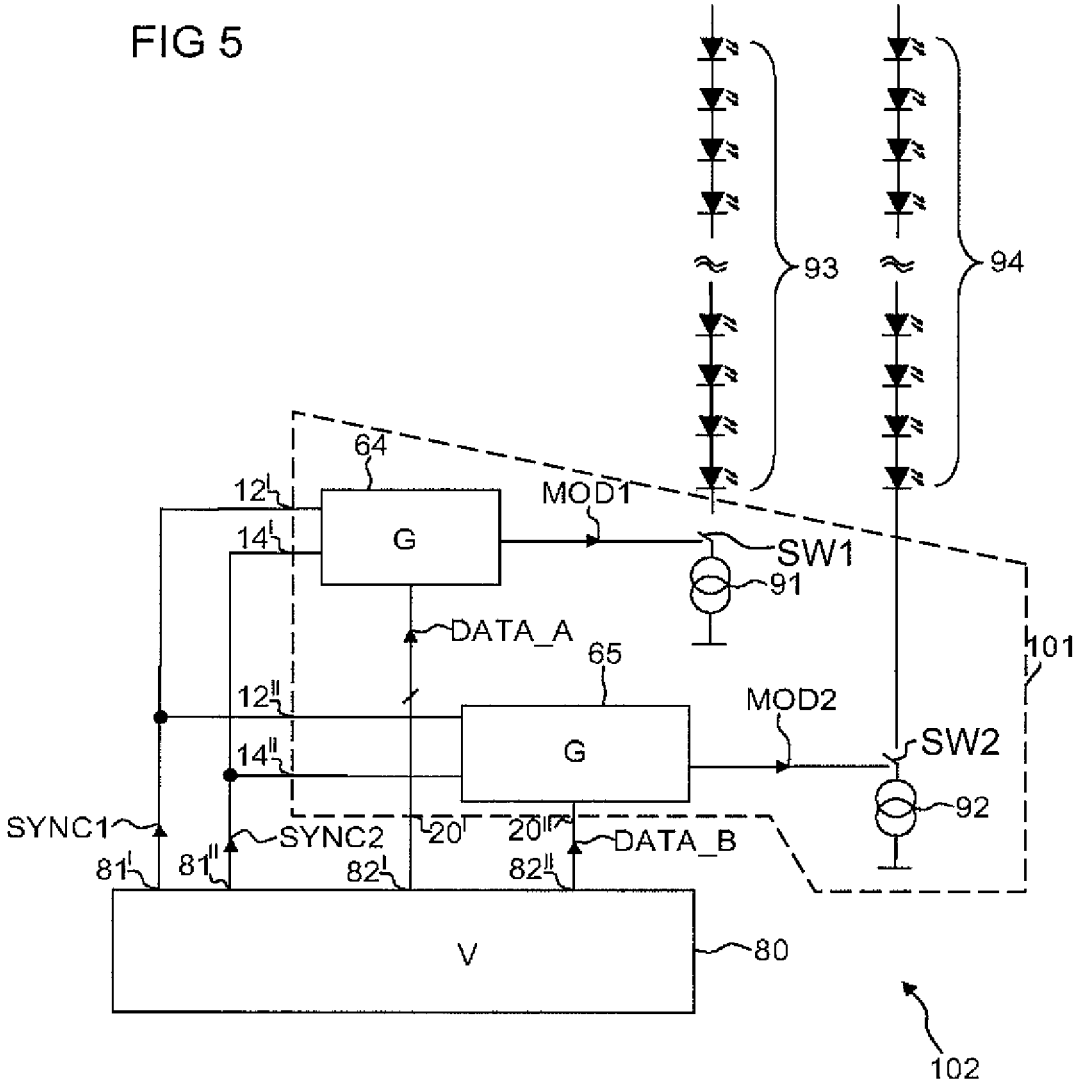
FIG. 5 shows an embodiment example of a display unit according to the invention with two segments.

FIG. 5 shows an embodiment example of a display unit 102 according to the invention with two LED segments of a segmented LED backlight. Display unit 102 comprises the digital video processor 80 of FIG. 1, a display driving unit 101, a first LED segment 93 and a second LED segment 94 of a segmented LED-backlight. Display driving unit 101 comprises a first generator 64, a second generator 65, a first switch, a second switch, a first current source 91 as an embodiment of driver 70 from FIG. 1, and a current source 92, likewise as an embodiment of driver 70 from FIG. 1. Generators 64 and 65 correspond in structure and function to the generator 50 of FIG. 1. Digital video processor 80 has an output 81' for providing the line signal SYNC1, an output 81" for providing the image signal SYNC2, an output 82' for providing a first data signal DATA_A, and an output 82" for providing a second data signal DATA_B. First generator 64 has a first input 12' to be supplied with the line signal SYNC1, an input 14' to be supplied with the image signal SYNC2, an input 20' for reading a first data signal DATA_A, and an output for providing the first modulated signal MOD1. Second generator 65 has an input 12" to be supplied with the line signal SYNC1, an input 14" to be supplied with the image signal SYNC2, an input 20" for reading the second data signal DATA_B, and an output for providing the second modulated signal MOD2. LED segments 93 and 94 each comprises a series circuit of several LEDs. Output 81' of digital video processor 80 is connected to input 12' of first generator 64 and to input 12" of second generator 65. Output 81" of digital video processor 80 is connected to input 14' of first generator 64 and to input 14" of second generator 65. Output 82' of digital video processor 80 is connected to input 20' of first generator 64. Output 82" of digital video processor 80 is connected to input 20" of second generator 65. The output of first generator 64 is connected to the first switch SW1. The output of second generator 65 is connected to the second switch SW2.

At its output 81', digital video processor 80 generates the line signal SYNC1, which comprises line frequency information of display unit 102. At its output 81", digital video processor 80 generates the image signal SYNC2, which comprises image frequency information of display unit 102. At its output 82", digital video processor 80 generates the first data signal DATA_A, which comprises the first image information value P, the second image information value M and the third image information value N. At its output 82", digital video processor 80 generates the second data signal DATA_B, which comprises the first image information value P, the second image information value M and the third image information value N. Digital video processor 80 additionally generates all signals that are necessary for the representation of an image on a display. Via a serial interface, first generator 64 reads image information values P, M and N present at its input 20'. By modulation of the first data signal DATA_A with the line signal SYNC1 and the image signal SYNC2, first generator 64 generates the first modulated signal MOD1 at its output. The first modulated signal MOD1 controls the first switch of the first LED-segment 93, which is operated by first current source 91. Via a serial interface, second generator 65 reads image information values P, M and N supplied via the second data signal DATA_B. By modulation of the line signal SYNC1 and the image signal SYNC2 with the first data signal DATA_B, second generator 65 generates the second modulated signal MOD2 at its output. The second modulated signal MOD2 controls the second switch of first LED-segment 94, which is operated by second current source 92.

Both the first modulated signal MOD1 and the second modulated signal MOD2 are advantageously synchronous with the line signal SYNC1 and the image signal SYNC2. Intermodulation noise is avoided by virtue of the fact that the driving of first LED segment 93 and second LED segment 92 are synchronized both among one another, as well as to the line frequency and the image frequency.

Figure 6:
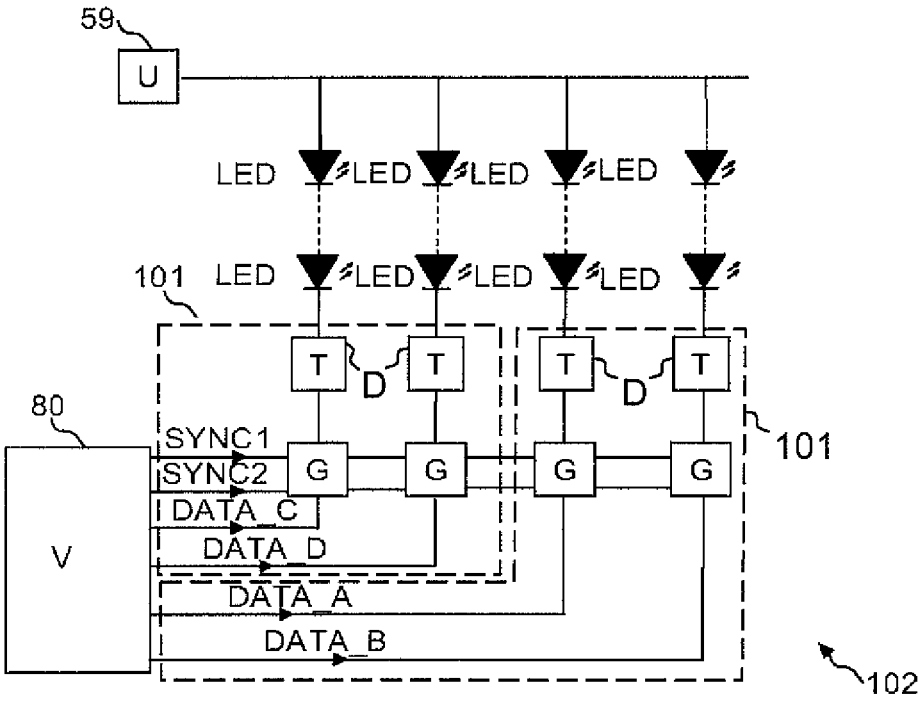
FIG. 6 shows another embodiment example of a display unit according to the invention with four segments.

FIG. 6 shows another embodiment example of the display unit 102 according to the invention with four LED segments of a segmented LED backlight. Display unit 102 comprises the display unit 102 of FIG. 5, as well as an additional display driving unit 101, two additional LED segments and a voltage supply 59. All told, four LED segments of a segmented LED backlight are driven. Differently from FIG. 5, the current source, including the associated switch, is shown in general in this embodiment as a driver D corresponding to the driver 70 of FIG. 1. In addition to that which is shown in FIG. 5, digital video processor 80 has two more outputs for providing a third data signal DATA_C and a fourth data signal DATA_D. The data signals DATA_C and DATA_D each has the image information values P, M and N that are generated for the associated LED segment. The outputs of the two display driving units 101 are each connected to the input of an LED segment. The LED signals are each additionally connected to voltage supply 59.

As described in FIG. 5, each display driving unit 101 provides two control signals at its output that are generated by modulation of the line signal and the image signal with the first or second data signal. Each control signal is supplied to an LED segment.

All LED segments are driven synchronously by the synchronous derivation of all control signals from the line frequency and the image frequency of display unit 102. Intermodulation noise is thus avoided.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A circuit arrangement for controlling a segmented LED backlight for a display unit, having a generator with at least one input adapted to be supplied with one or more synchronizing signals comprising line frequency information and image frequency information of the display unit, an additional input to be supplied with a data signal that comprises an image delay information item and an image brightness information item of a respective segment of the segmented LED backlight, and with an output for providing a modulated signal for controlling the segmented LED backlight, wherein the generator is configured to provide the modulated signal as a function of the data signal such that the image frequency information is delayed by the image delay information item, a leading edge of the modulated signal is synchronized with the line frequency information and a pulse of the delayed image frequency information, and a trailing edge of the modulated signal is synchronized with the line frequency information and a pulse of the image frequency information.

2. The circuit arrangement according to claim 1, wherein one or more of the at least one input adapted to be supplied with the one or more synchronizing signals of the generator is coupled to a phase-locked loop.

3. The circuit arrangement according to claim 1, wherein the generator is configured so that the modulated signal is clocked to the one or more synchronizing signals.

4. The circuit arrangement according to claim 1, wherein the generator is configured to provide the modulated signal as a function of a modulation of the one or more synchronizing signals with the data signal.

5. The circuit arrangement according to claim 1, wherein the generator comprises a pulse-width modulator.

6. The circuit arrangement according to claim 1, wherein the generator comprises a sigma-delta modulator.

7. A display driving unit with a circuit arrangement according to claim 1, comprising a driver with an input that is coupled to the output of the generator, and to an output adapted to be connected to an LED segment of the segmented LED backlight in particular.

8. A display driving unit according to claim 7, comprising:

another one of said circuit arrangement, with an input to be supplied with a one of the one or more synchronizing signals that comprises line frequency information of the display unit, an additional input to be supplied with an additional data signal that comprises image information for an additional connectable LED segment, and with an output for providing an additional modulated signal; and an additional driver with an input to be supplied with the additional modulated signal and an output adapted to be coupled to the additional connectable LED segment of the segmented LED backlight.

9. The display driving unit according to claim 8, wherein the one of the one or more synchronizing signals comprises image frequency information and line frequency information of the display unit.

10. A display unit with a display driving unit according to claim 8, comprising:

a digital video processor with outputs for providing the synchronizing signal and for providing at least a first and a second data signal for driving a first and a second LED segment, wherein the outputs of the digital video processor are coupled to associated inputs of the display driving unit;

and at least a first and a second LED segment of the segmented LED backlight, each connected to outputs of the display driving unit.

11. A method for generating a modulated signal for controlling a segmented LED backlight for a display unit, the method comprising:

supplying a synchronizing signal that comprises line frequency information and image frequency information of the display unit;

supplying a data signal that has at least an image delay information item and an image brightness information item of a respective segment of the segmented LED backlight; and providing a modulated signal for controlling the segmented LED backlight such that the image frequency information is delayed by the image delay information item, a leading edge of the modulated signal is synchronized with the line frequency information and a pulse of the delayed image frequency information, and a trailing edge of the modulated signal is synchronized with the line frequency information and a pulse of the image frequency information.

12. The method according to claim 11, wherein the synchronizing signal is supplied via a phase-locked loop.

13. The method according to claim 11, wherein the providing the modulated signal is performed by pulse-width modulation.

14. The method according to claim 11, wherein the providing the modulated signal is performed by sigma-delta modulation.

15. The method according to claim 11, wherein the modulated signal is supplied to at least a first segment of a plurality of segments of the segmented LED backlight.

16. A circuit arrangement for controlling a segmented LED backlight for a display unit, having a generator with at least one input adapted to be supplied with one or more synchronizing signals comprising line frequency information and image frequency information of the display unit, an additional input to be supplied with a data signal that comprises an image delay information item and an image brightness information item of a respective segment of the segmented LED backlight, and with an output for providing a modulated signal for controlling the segmented LED backlight, wherein the generator is configured to provide a delayed signal such that the image frequency information is delayed by the image delay information item and the delayed image frequency information is synchronized with the line frequency information, and wherein the generator is further configured to provide the modulated signal by combining the delayed image frequency information with the image brightness information item in a pulse-width modulation such that a leading edge of the modulated signal is synchronized with a pulse of the delayed image frequency information and a trailing edge of the modulated signal is synchronized with a pulse of the image frequency information.

17. A method for generating a modulated signal for controlling a segmented LED backlight for a display unit, the method comprising:

supplying a synchronizing signal that comprises line frequency information and image frequency information of the display unit;

supplying a data signal that has at least an image delay information item and an image brightness information item of a respective segment of the segmented LED backlight;

providing a delayed signal such that the image frequency information is delayed by the image delay information item and the delayed image frequency information is synchronized with the line frequency information; and providing a modulated signal for controlling the segmented LED backlight by combining the delayed image frequency information with the image brightness information item in a pulse-width modulation such that a leading edge of the modulated signal is synchronized with a pulse of the delayed image frequency information and a trailing edge of the modulated signal is synchronized with the image frequency information.

18. The circuit arrangement according to claim 1, wherein the generator is configured to provide the modulated signal by combining the delayed image frequency information with the image brightness information item in a pulse-width modulation.

19. A circuit arrangement for controlling a segmented LED backlight for a display unit, the circuit arrangement comprising:

a generator comprising:

at least one input adapted to be supplied with one or more synchronizing signals comprising line frequency information and image frequency information of the display unit;

an additional input adapted to be supplied with a data signal comprising an image delay information item and an image brightness information item of a respective segment of the segmented LED backlight; and an output for providing a modulated signal for controlling the segmented LED backlight;

wherein the generator is configured to:

delay the image frequency information based on the image delay information item, generate a leading edge of a pulse of the modulated signal to allow the leading edge to be synchronized with the line frequency information and allow the leading edge to be synchronized with a pulse of the delayed image frequency information, and generate a trailing edge of the pulse of the modulated signal to allow the trailing edge to be synchronized with the line frequency information and to allow the trailing edge to be synchronized with a pulse of the image frequency information.

20. The circuit arrangement according to claim 19, wherein the generator is further configured to:

generate a leading edge of a subsequent pulse of the modulated signal to allow the leading edge of the subsequent pulse to be synchronized with the line frequency information and to allow the leading edge of the subsequent pulse to be initiated prior to an additional pulse of the delayed image frequency information.

* * * * *